US007507048B2

(12) United States Patent
Colarusso et al.

(10) Patent No.: US 7,507,048 B2
(45) Date of Patent: Mar. 24, 2009

(54) DEFORMED REINFORCING BAR SPLICE AND METHOD

(75) Inventors: Louis Colarusso, Macedonia, OH (US); Mark Victor Samas, Willoughby Hills, OH (US)

(73) Assignee: ERICO International Corporation, Solon, OH (US)

( * ) Notice: Subject to any disclaimer, the term of this patent is extended or adjusted under 35 U.S.C. 154(b) by 1066 days.

(21) Appl. No.: 10/965,339

(22) Filed: Oct. 14, 2004

(65) Prior Publication Data

US 2005/0050843 A1 Mar. 10, 2005

Related U.S. Application Data

(62) Division of application No. 10/603,367, filed on Jun. 25, 2003, now Pat. No. 6,880,224.

(51) Int. Cl.
*F16D 1/00* (2006.01)

(52) U.S. Cl. ..... 403/286; 403/293

(58) Field of Classification Search ..... 29/456, 29/525.11, DIG. 18, DIG. 41; 403/286–314; 52/726.1; 72/89, 103
See application file for complete search history.

(56) References Cited

U.S. PATENT DOCUMENTS

| | | | |
|---|---|---|---|
| 2,666,348 | A | 1/1954 | Trishman |
| 3,415,552 | A | 12/1968 | Howlett |
| 3,835,690 | A | 9/1974 | Leonhardt et al. |
| 3,850,535 | A | 11/1974 | Howlett et al. |
| 3,858,846 | A | 1/1975 | Schmid |
| RE31,084 | E | 11/1982 | Birks |
| 4,584,247 | A | 4/1986 | Mulholland |
| 4,619,096 | A | 10/1986 | Lancelot, III |
| 4,752,159 | A | 6/1988 | Howlett |
| 4,870,848 | A | 10/1989 | Kies et al. |
| 5,054,146 | A | 10/1991 | Wiesenfeld et al. |
| 5,131,204 | A | 7/1992 | Hiendl |
| 5,152,118 | A | 10/1992 | Lancelot |
| 5,158,527 | A | 10/1992 | Bernard |
| 5,411,347 | A | 5/1995 | Bowmer et al. |

(Continued)

FOREIGN PATENT DOCUMENTS

| | | |
|---|---|---|
| CN | 96 15047.9 | 1/1998 |

(Continued)

OTHER PUBLICATIONS

*Lenton Anschlußbewehrung*, Erico B.V., 1987 (7 page brochure).

(Continued)

*Primary Examiner*—Victor MacArthur
(74) *Attorney, Agent, or Firm*—Renner, Otto, Boisselle & Sklar, LLP

(57) ABSTRACT

A process for forming an improved tensile strength deformed reinforcing bar splice for use in concrete construction by radially compressing or cold forming the bar end with dies literally to flatten any ribs or deformations on the bar end to cold work a section of the bar end which will extend beyond any threaded section and the mouth of a coupler thereon. The splice formed has superior tensile qualities. The process is inexpensive and may be accomplished at or near a construction site.

28 Claims, 6 Drawing Sheets

U.S. PATENT DOCUMENTS

| | | | |
|---|---|---|---|
| 5,660,594 | A | 8/1997 | Viljakainen |
| 5,776,001 | A | 7/1998 | Carter |

FOREIGN PATENT DOCUMENTS

| | | | |
|---|---|---|---|
| CN | 97107856.4 | | 7/1999 |
| EP | 0947642 | | 10/1999 |
| EP | 1048798 | | 11/2000 |
| GB | 2 227 802 | A | 8/1990 |
| WO | WO 00/47349 | | 8/2000 |

OTHER PUBLICATIONS

Bar Tec *Splicing System* CCL Systems (4 page brochure).

DEFORMED REINFORCING BAR SPLICE AND METHOD

RELATED APPLICATION

This application is a divisional of application Ser. No. 10/603,367 filed Jun. 25, 2003 entitled Deformed Reinforcing Bar Splice and Method, now U.S. Pat. No. 6,880,224.

DISCLOSURE

This invention relates generally to a deformed reinforcing bar splice and method and more particularly to a bar splice and method which will achieve higher tensile strength, bar break (full ultimate) splices with minimal field working, energy, fabrication and cost.

BACKGROUND OF THE INVENTION

Conventional taper thread deformed reinforcing bar couplers have been sold for many years throughout the world under the trademark LENTON®. LENTON® is a registered trademark of ERICO INTERNATIONAL Corporation of Solon, Ohio, U.S.A. Taper threads are preferred because of the ease of assembly requiring only a few turns of the sleeve coupler or bar and the ability to avoid cross threading and subsequent damage to the threads.

The threading process cuts the taper threads in the deformed bar end including the nominal diameter and any projecting ribs or deformations. The process however notches the bar and such couplings will not normally achieve bar break tensile capability.

In order to achieve higher tensile strength bar splices it has been attempted literally to upset the bar end to obtain a larger diameter end section which then receives a tapered or straight thread which has a larger pitch diameter than the nominal diameter of the bar. In the case of tapered threads the average thread diameter is larger than the bar nominal diameter. Such bars can achieve bar break but at a considerable cost in energy and handling. To achieve such upset bar end, the bar end literally has to be forged with substantial axial force or forge hammering. This is complicated by the fact that reinforcing bar, when cut, generally has a bent end caused by shear equipment, and if the bars are of any length or size the handling and conveying problems result in very high cost bar splices to achieve the desired minimal increase in strength.

A published U.K. Patent Application No. 2 227 802A illustrates a tapered thread bar splice having an enlarged or upset tapered threaded end. More importantly this published patent illustrates the sizable machinery including a large ram and clamps required to upset the bar end all prior to threading. The operation is simply not something that can be done easily, locally, or at a construction or fabrication site. Also to be economical the operation requires large volumes of inventory and careful handling and transportation.

Another simplified example of the type of machinery required is seen in U.S. Pat. No. 5,660,594.

Examples of such prior devices involving high cost forging or upsetting are seen in LENTON® continuity sets sold by applicant. The splices involve tapered threads on forged or upset bar ends.

Straight thread couplers on forged or upset bar ends are seen in U.S. Pat. Nos. 4,619,096, 5,158,527, and 5,152,118.

CCL Systems of Leeds, England also markets a BARTEC system where the bar ends have been enlarged and threaded to mate with parallel sleeve threads.

A coupling similar to that of the above U.K. published patent application is shown in Chinese published application 97107856.4.

It has however been discovered that similar tensile benefits can be achieved without the necessity of the costly upsetting or enlargement of the bar end.

SUMMARY OF THE INVENTION

With the present invention, the deformed bar end is strengthened by cold forming prior to threading, and particularly in the area of the thread at the mouth of the coupler. The cold forming process work hardens the bar end and increases the tensile properties at the thread area enough to create a bar splice capable of achieving bar break.

The swaging or cold forming is accomplished solely by radial compression and in the process flattens or deforms any radially projecting ribs or ridges on the bar end. After the radial compression cold forming operation flattening the ribs, the bar end section is then formed with tapered or straight threads by cutting or rolling. The cold swaging process also has the advantage of straightening the bar end which may be slightly bent due to shear equipment. The cold formed section is accordingly straightened to facilitate threading.

The radial compression or cold forming also alleviates problems with reinforcing bar ductility and cracking. More importantly the bar is much easier to handle and does not have to be clamped or blocked against axial movement.

In a preferred cold forming die configuration, the dies form a generally cylindrical area and an adjoining tapered area of the bar, the latter receiving the tapered threads while the former extends the cold formed area beyond what will be the coupler mouth. With this preferred form the taper threading requires less material removal if cut and enhanced cold working both throughout the length of the thread and beyond the mouth of the coupler along the bar.

The cold forming operation as well as cutting and threading may be accomplished on site or in a nearby fabrication shop. Heavy and expensive forging or upsetting machinery and related bar handling is not required to achieve improved bar splice performance.

The radial cold forming or compression process is much easier and less expensive to accomplish than axial upsetting yet provides improved splice performance characteristics providing superior strength connections using standard threaded couplers which install easily with hand tools and which will work on any rebar size world wide.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
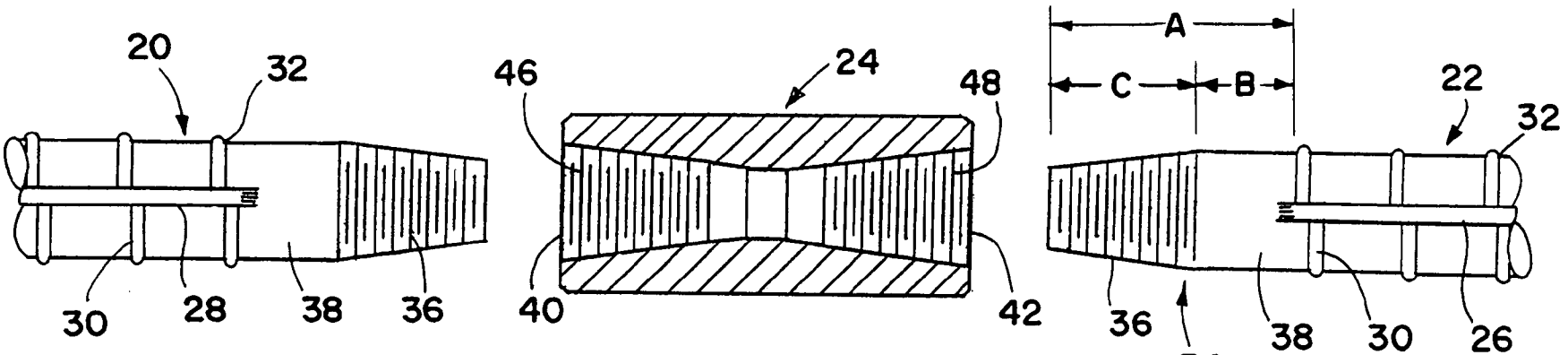
FIG. 1 is an exploded view partially in section of a taper thread deformed bar coupling in accordance with the present invention.

Referring initially to FIG. 1 there is illustrated the components of a taper thread deformed reinforcing bar splice in accordance with the present invention. The splice includes bar 20, bar 22, and the joining internally threaded sleeve 24. While the bars shown are of the same size, they can vary in bar size by use of well known transition couplers with different size threads in each end matching that of the bars. The bar 22 and its threaded end will be described in detail.

Typically, the bar is deformed during the rolling process and is provided with longitudinal diametrically opposite long ribs shown at 26 and 28 on opposite sides of the bar. Included are circumferential ribs 30 somewhat offset from circumferential ribs on the opposite side as shown at 32.

It will be appreciated that commercially available reinforcing bar may be provided with a wide variety of rib or deformation patterns. Such patterns usually include the longitudinal diametrically opposite ribs and circumferential ribs extending either normal to the axis of the bar or at an angle. Some bars are provided with thread form deformations. For more details of the various bar deformations available, reference may be had to various publications of the Concrete Reinforcing Steel Institute (CRSI) of Chicago, Ill., U.S.A. It will also be appreciated that deformed bars of the type illustrated come in various sizes and bar size designations may vary from Number #3 (10 mm) to Number #18 (57 mm), for example, A Number #3 (10 mm) bar may, for example, have a nominal diameter of 0.375" and weigh about 0.376 pounds per foot. On the other hand a Number #18 (57 mm) bar may have a nominal diameter of 2.257" and weigh 13.6 pounds per foot. Needless to say that when bars are of the larger size and substantial length, they become difficult to handle, clamp, and properly support.

The bar 22 has a cold formed insection 34 (A) which includes a threaded tip section 36 (C) and an unthreaded cold formed swaged cylindrical section 38 (B). The capital letters, as illustrated at the right hand side of FIG. 1 refer to the axial length of such sections. It is preferable that the axial length of the swaged section (A) be substantially longer than the length of the threads (C) so that the ends or mouth of the coupler shown at 40 and 42 will be well within the swaged area (A). When the coupler is assembled the mouth 42 will be substantially at the inner end of the thread section (C) and at least the distance (B) extends beyond the mouth of the coupler. The length of the extending swaged section (B) is about one-half of (C) and preferably from about ⅓ to about ⅔ of (C), or more. Stated another way, the extending swaged section (B) is about ⅓ to about ⅔ of (A). Preferably, the length of the threads (C) is from about ⅔ to about ½ of (A).

The sleeve 24 may be formed from hex or round stock and has internal threads at each end shown at 46 and 48, matching the tapered threads at 36. The internal tapered threads in the sleeve 24 are slightly longer than the external threads on the tapered bar end but the sleeve may be assembled quickly to the bar ends with relatively few turns and correct torque.

Figure 2:
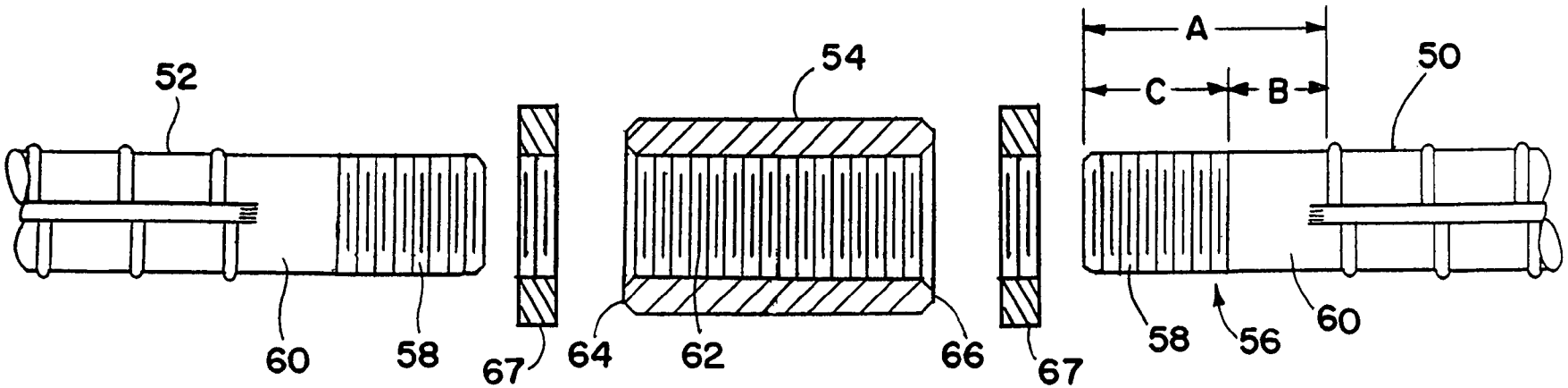
FIG. 2 is a similar view of a straight or parallel thread bar coupling in accordance with the present invention.

A similar splice or coupling is shown in FIG. 2 but instead of taper threads the bar ends and coupling sleeve are provided with straight or parallel threads. As in the tapered thread couplers the bar ends have a section or area which has been cold formed indicated by the dimension (A) shown at 56 which includes the thread length (C) shown at 58 and cylindrical swaged section (B) shown at 60. The sleeve 54 also may be formed from hex or round stock and has a completely threaded internal bore indicated at 62. The sleeve will be threaded on one bar end and the other bar end into the sleeve until the bar ends abut at substantially the midpoint of the sleeve. The sleeves and/or bars are tightened to form the splice. The parallel thread connection shown in FIG. 2 requires much more turning and manipulation of the bars than the taper thread connection seen in FIG. 1. When the bars abut and are tightened, each mouth of the sleeve shown at 64 and 66 will be positioned approximately at the ends of the threads (C) and well within the swaged section (A). Locking rings 67 threaded on the bars may be tightened against the sleeve ends to secure the coupling and reduce any play or slip.

Figure 3:
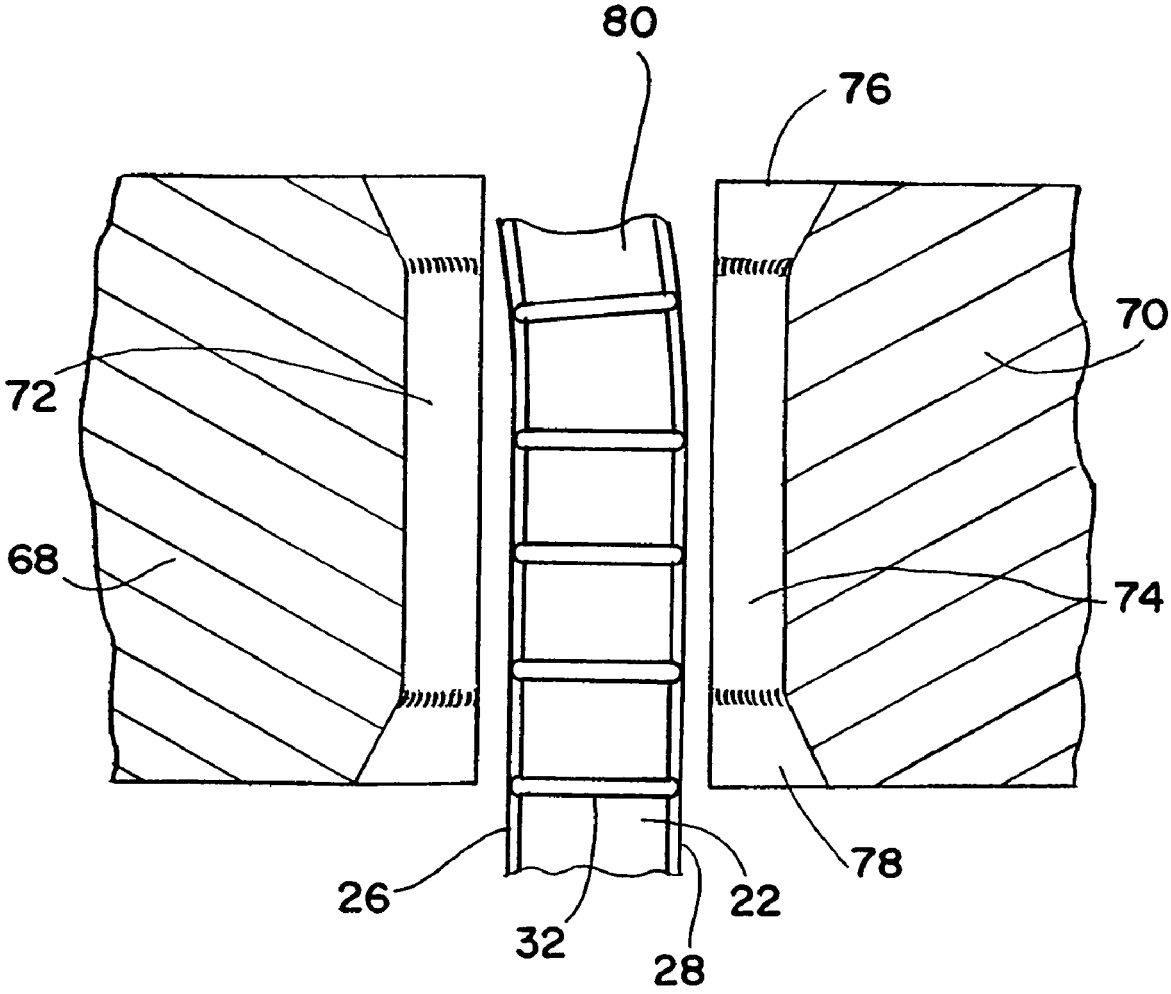
FIG. 3 is a section through open cold forming dies showing a cut deformed bar end prior to forming.
Figure 4:
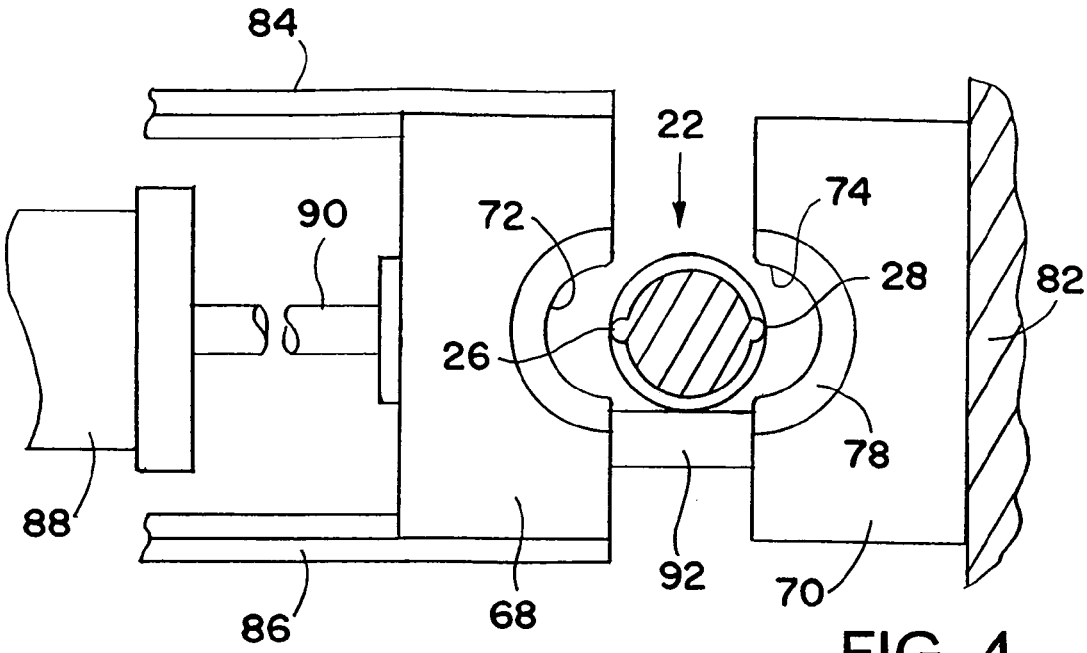
FIG. 4 is an elevation view of the cold forming dies taken normal to the plane of FIG. 3, but with the bar in section.
Figure 5:
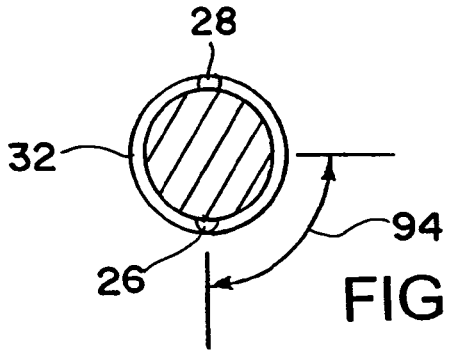
FIG. 5 illustrates the bar being rotated for multiple cold forming operations, if desired.

Referring now to FIGS. 3 through 6, there is illustrated the process of cold forming the bar end to obtain the cold worked section (A) prior to threading. The cold forming process is accomplished by radially compressing the bar 22 between two dies shown at 68 and 70, which includes cylindrical half round cavities shown at 72 and 74, respectively. Each cavity includes a flared end such as seen at 76 and 78 to avoid pressing a sharp corner into the bar. The radius of the cylindrical portion of the cavity is approximately equivalent the nominal diameter of the bar 22. The nominal diameter of the bar is the diameter of the core of the bar not including the projecting deformations such as the ribs 26, 28, or 32. Also, as seen in FIG. 3, when cut by shear equipment, the bar end tends to be slightly bent as shown at 80 and any bent portion of the bar between the dies will be straightened during the compression or cold forming steps.

Figure 6:
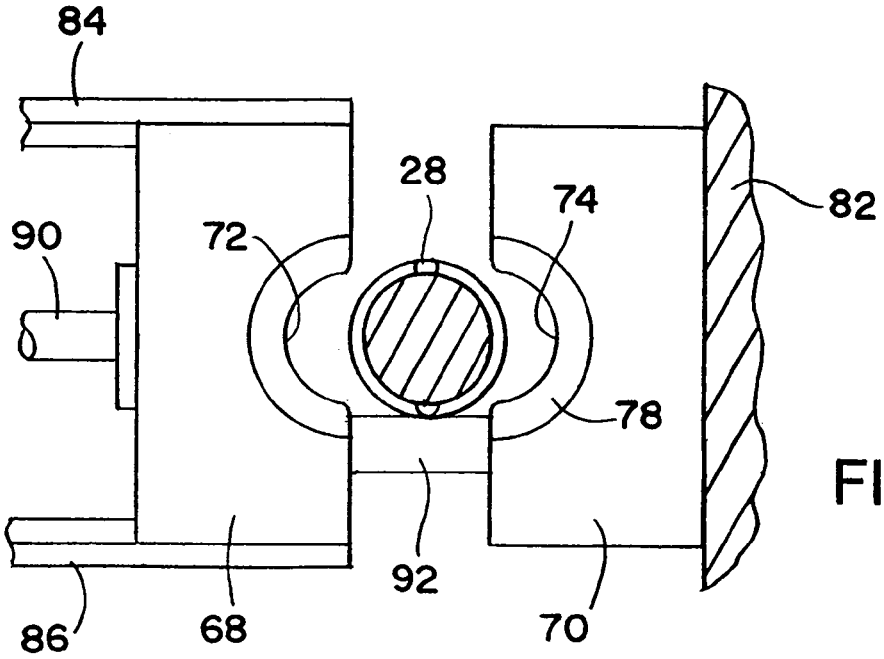
FIG. 6 is a view like FIG. 4 showing the bar being subjected to a typical second forming operation, if desired.

The die 70 may be fixed as indicated at 82, while the die 68 is mounted in slides 84 and 86 and is moved between opened and closed positions by relatively large piston-cylinder assembly 88 connected to the die by rod 90. The bar is supported by several rests or a table indicated at 92 in the proper position for die engagement when the dies are closed. No complex or powerful clamps are required to keep the bar from moving axially, although bar end gauges may be provided simply to position the bar properly from one or the other ends. When the dies are closed the section of the bar between the cylindrical portions of the die cavities will be radially compressed and the force of the dies literally will flatten any projections on the bar end section being compressed. Preferably, the bar end section may be subject to two such compression operations and between such first and second compression operations the bar is rotated about its axis 90° as indicated by the arrow 94 in FIG. 5. After such axial rotation, if desired, the bar end section being formed is subjected to a second compression stroke as indicated in FIG. 6. It may be appreciated that additional compression strokes may be performed on the bar end section being cold formed, but it has been found that one or two are sufficient substantially to flatten or compress any of the projecting ribs or deformations on the bar end section and further compression steps are of minimal cold working value.

Figure 7:
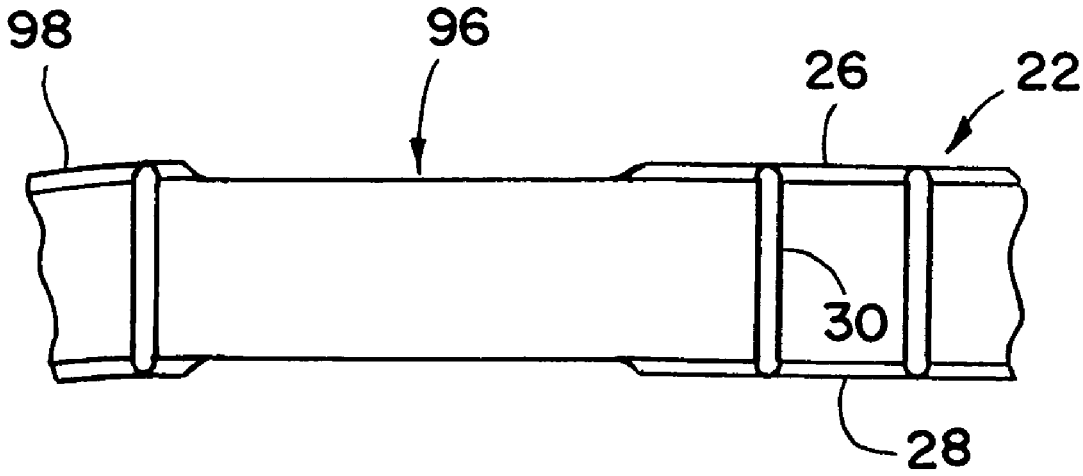
FIG. 7 is a fragmentary side elevation of the bar showing the formed and cold-worked section.
Figure 8:
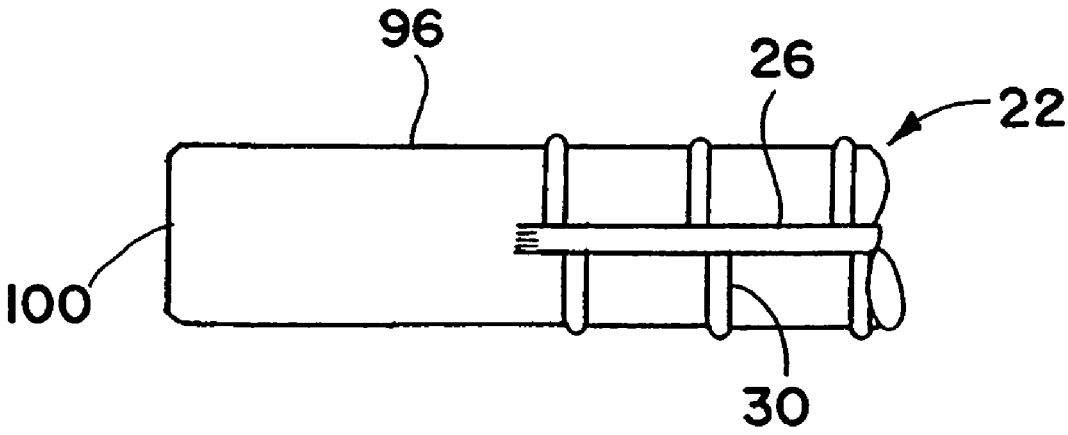
FIG. 8 is a similar view of a bar with full cold formed area ready for bar end threading with either taper or straight threads.

Referring now to FIGS. 7 and 8, it will be seen that the bar 22 cold worked by the dies 68 and 70 now has a section indicated at 96 which has been subjected to the die pressure by radial compression and such radial compression has literally flattened any ribs or projections into the core of the bar and has cold worked the bar end throughout the section 96. If desired, the tip of the bar indicated at 98 extending beyond the formed or compressed section 96 may be cut off leaving a bar end such as seen in FIG. 8 with the cold worked section 96 to receive the threads of either FIG. 1 or FIG. 2. The bar tip 98 may be cut off either prior to or during the threading operation. Tapered or parallel threads may then be formed on the bar end either by cutting or rolling producing a bar end such as seen in FIG. 1 or 2. The length of the threads from the tip 100 will not embrace the entire cold worked or compressed section 96 but rather leave a rather substantial portion so that the cold worked section of the bar end extends well beyond the mouth of the coupler.

Figure 9:
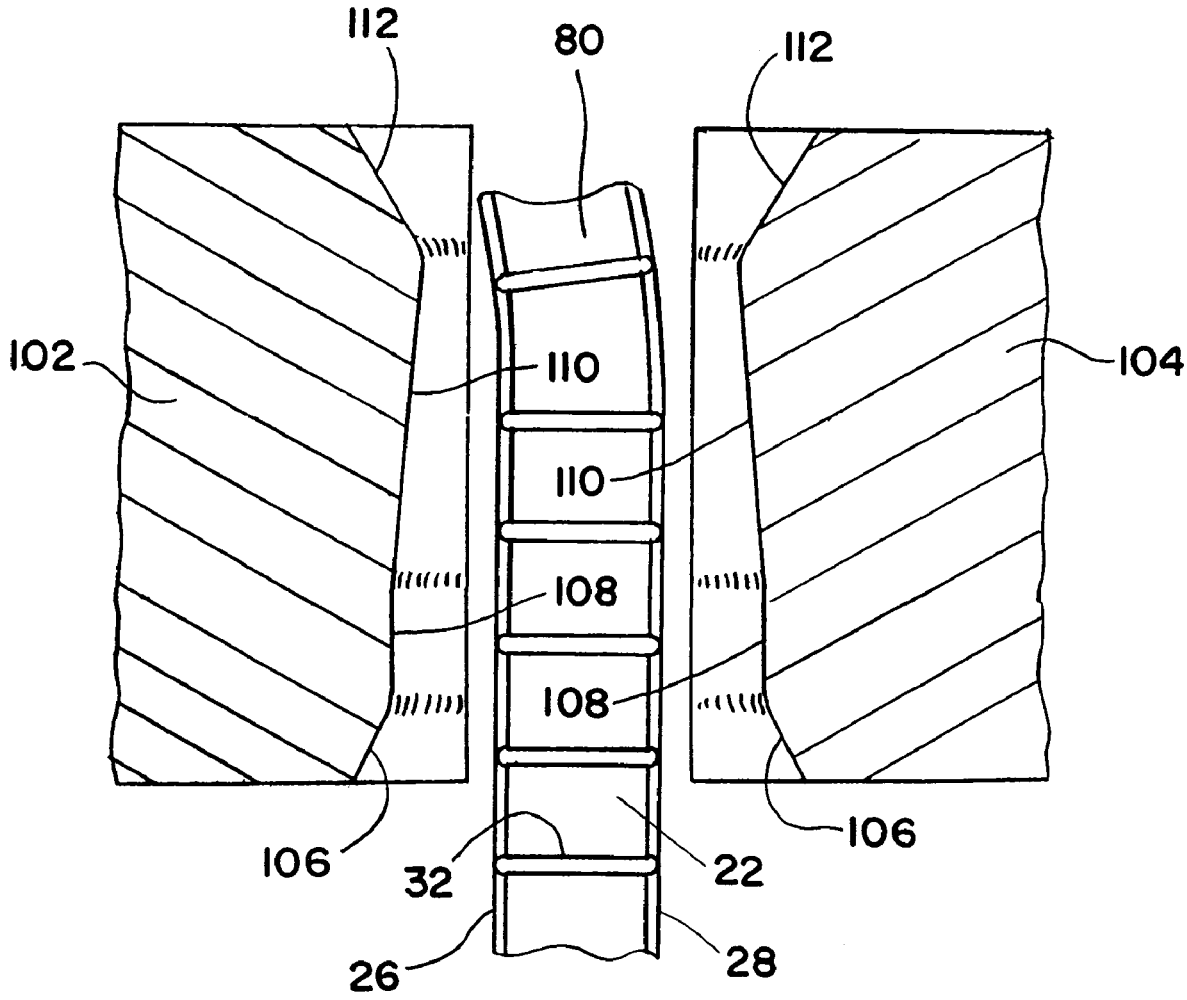
FIG. 9 is a view like FIG. 3 but showing a modified cold forming die configuration which forms a taper on the bar end to facilitate taper threading.
Figure 10:
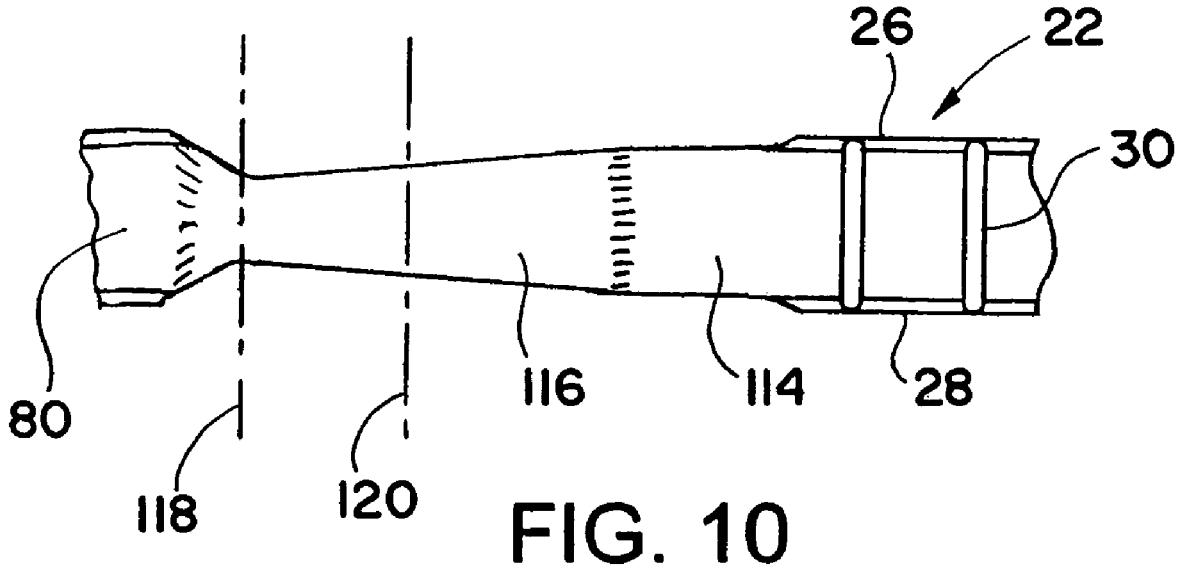
FIG. 10 is a fragmentary elevation of the bar end after cold forming with the dies of FIG. 9 requiring tip removal.

FIG. 9 is a view like FIG. 3 but the dies shown at 102 and 104 have a slightly different configuration. As seen in FIG. 9 each half round die section includes a flared entrance 106, a cylindrical section 108, a somewhat longer tapered section 110 and a flared entrance 112. Subjecting the bar, if desired, to two radial compressions with the bar being rotated 90° between such compressions produces a bar end tapered formed configuration such as shown in FIG. 10. The cylindrical section 108 of the dies produces the cylindrical section 114 on the bar end while the tapered section 110 produces the tapered section 116.

Figure 11:
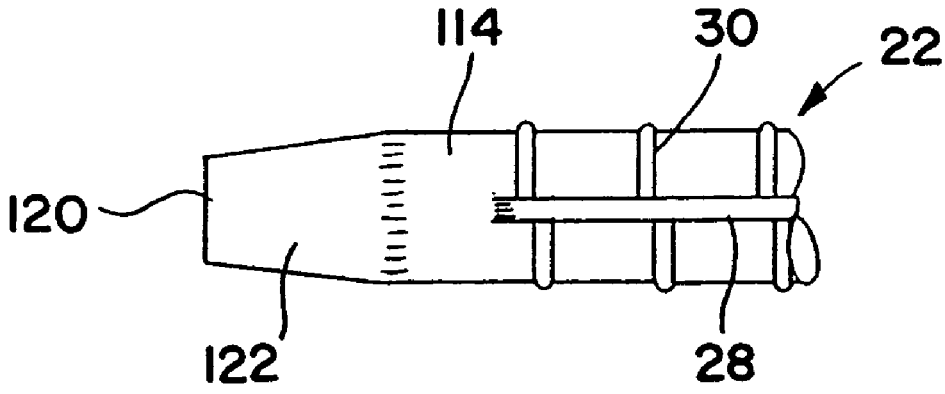
FIG. 11 is a fragmentary view of the bar end of FIG. 10 ready for taper threading to produce the bar end seen in FIG. 1.

The bar end or tip may be cut off as indicated at 118 or 120 depending upon the length of the taper desired. If cut off at 120 this leaves the somewhat shorter tapered cold formed section 122 seen in FIG. 11 which is adjacent to the cylindrical cold formed section 114. The cold worked and tapered section 122 may now be provided with tapered threads either cut or rolled. If cut, the process requires less metal or material to be removed in the thread forming operation. It also facilitates taper thread rolling. Again the cold worked, formed, or radially compressed area of the bar end extends well beyond the tapered section and thus will extend beyond the mouth of the coupler when the splice is completed.

It can now be seen that there is provided a coupling or splice for deformed concrete reinforcing bar which provides an enhanced tensile capability at minimal cost. The bar end is cold formed or radially compressed to improve its strength by cold working literally flattening or compressing the projections in an area of the bar end prior to threading. The length of the cold working of the bar by such radial compression forming is longer than the length of the threads on the bar end so that the mouth of the coupler will be positioned well within the area of forming or cold working.

With the present invention a splice or coupler of superior tensile capabilities can be achieved with minimal field working and cost.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

The invention claimed is:

1. An improved performance deformed reinforcing bar splice comprising an internally threaded sleeve with mouth ends, and bar ends having bar threads matching the sleeve threads, said sleeve being tightened on said bar ends, and said bars having a cold formed area on each end extending axially longer along the bar ends than the bar threads.

2. A splice as set forth in claim 1 wherein said bar threads extend from about ½ to about ⅔ the length of the cold formed area.

3. A splice as set forth in claim 1 wherein said threads are tapered and said cold formed area extends well beyond the mouth of the sleeve.

4. A splice as set forth in claim 1 wherein said threads are parallel and said cold formed area extends well beyond the mouth of the sleeve.

5. A splice as set forth in claim 4 including a locking ring threaded on the bar ends and tightened against the mouth of the sleeve to reduce slip.

6. A splice as set forth in claim 5 wherein the cold formed area of the bar extends beyond the locking ring.

7. A splice as set forth in claim 1 wherein the cold formed area of the bar ends is substantially cylindrical with any deformations on the bar in such area being flattened.

8. A splice as set forth in claim 1 wherein said threads are tapered and cut.

9. A splice as set forth in claim 1 wherein said bar threads are rolled.

10. A splice as set forth in claim 1 wherein said sleeve is formed from hex or round stock.

11. A bar connection for deformed reinforcing bar in concrete construction comprising an internally threaded sleeve having a mouth end, and a bar end having external bar threads matching the sleeve threads, the bar end being tightened in the sleeve, and said bar end having a cold formed area extending axially longer than the bar threads and including a non-threaded portion of the bar end so that when the bar end is tightened the cold formed area projects substantially beyond the mouth of the sleeve.

12. A connection as set forth in claim 11 wherein said bar threads extend from about ½ to about ⅔ the length of the cold formed area.

13. A connection as set forth in claim 11 wherein said threads are tapered and said cold formed area extends well beyond the mouth of the sleeve.

14. A connection as set forth in claim 11 wherein the cold formed area of the bar end is substantially cylindrical with any deformations on the bar in such area being flattened.

15. A connection as set forth in claim 11 wherein said threads are tapered and cut.

16. A connection as set forth in claim 11 wherein said bar threads are rolled.

17. A connection as set forth in claim 11 wherein said threads are parallel and said cold formed area extends well beyond the mouth of the sleeve.

18. A connection as set forth in claim 17 including a locking ring threaded on the bar ends and tightened against the mouth of the sleeve to reduce slip.

19. A connection as set forth in claim 18 wherein the cold formed area of the bar extends beyond the locking ring.

20. A connection as set forth in claim 11 wherein said threads are tapered and said cold formed area extends well beyond the mouth of the sleeve.

21. A connection as set forth in claim 20 wherein the cold formed area of the bar end is substantially cylindrical with any deformations on the bar in such area being flattened.

22. A connection as set froth in claim 21 wherein said threads are tapered and cut.

23. A connection as set forth in claim 22 wherein said bar threads are rolled.

24. A connection as set forth in claim 23 wherein said sleeve is formed from hex or round stock.

25. A connection as set forth in claim 22 wherein the bar threads extend a dimension C from the end of the bar while the cold formed area extends a dimension A which is substantially longer than C.

26. A connection as set forth in claim 25 wherein the difference between A and C is about ⅓ to about ½ of A.

27. A connection as set forth in claim 25 wherein the entire cold formed area A is formed by radially flattening any deformations on the bar end.

28. A connection as set forth in claim 25 wherein the entire cold formed area A is formed by radial compression of the bar without axial compression.

* * * * *